US011705038B2

(12) United States Patent
Yao et al.

(10) Patent No.: US 11,705,038 B2
(45) Date of Patent: Jul. 18, 2023

(54) DISPLAY DRIVING MODULE, DISPLAY DRIVING METHOD AND DISPLAY DEVICE

(71) Applicants: Fuzhou BOE Optoelectronics Technology Co., Ltd., Fujian (CN); BOE Technology Group Co., Ltd., Beijing (CN)

(72) Inventors: Wenjian Yao, Beijing (CN); Xue Yu, Beijing (CN); Nani Liu, Beijing (CN); Weiming Yu, Beijing (CN); Yifeng Su, Beijing (CN); Xiaoli Kong, Beijing (CN); Jinfeng Chen, Beijing (CN); Qibiao Lin, Beijing (CN); Xuening Zhao, Beijing (CN); Zhe Huang, Beijing (CN); Hongjiang Wu, Beijing (CN)

(73) Assignees: Fuzhou BOE Optoelectronics Technology Co., Ltd., Fujian (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/552,349

(22) Filed: Dec. 15, 2021

(65) Prior Publication Data

US 2022/0270531 A1 Aug. 25, 2022

(30) Foreign Application Priority Data

Feb. 24, 2021 (CN) ..... 202110208246.8

(51) Int. Cl.
*G09G 3/20* (2006.01)

(52) U.S. Cl.
CPC ..... *G09G 3/20* (2013.01); *G09G 2310/0267* (2013.01); *G09G 2320/0219* (2013.01); *G09G 2320/0223* (2013.01); *G09G 2330/021* (2013.01)

(58) Field of Classification Search
None
See application file for complete search history.

(56) References Cited

U.S. PATENT DOCUMENTS

2004/0070579 A1* 4/2004 Kurihara ..... G09G 3/2011 345/204
2015/0194121 A1* 7/2015 Lee ..... G09G 3/3677 345/212
2017/0110076 A1* 4/2017 Hwang ..... G09G 3/3648
2017/0345360 A1* 11/2017 Lee ..... G09G 3/2092

* cited by examiner

*Primary Examiner* — Dorothy Harris
(74) *Attorney, Agent, or Firm* — IPro, PLLC

(57) ABSTRACT

A display driving module, a display driving method, and a display device are provided. The display driving module includes a clock signal line, a clock signal generating circuit and a gate driving circuit, where the gate driving circuit includes multiple stages of gate driving units; the clock signal generating circuit is electrically connected to the clock signal line and is configured to generate at least two clock signals and provide different clock signals to the clock signal line in a time-sharing manner; the gate driving unit is electrically connected to the clock signal line and configured to generate a gate driving signal according to the clock signals on the clock signal line; when potentials of the clock signals are valid voltages, the potentials of different clock signals are different.

11 Claims, 3 Drawing Sheets

DISPLAY DRIVING MODULE, DISPLAY DRIVING METHOD AND DISPLAY DEVICE

CROSS-REFERENCE TO RELATED APPLICATIONS

This application claims priority to Chinese Patent Application No. 202110208246.8 filed in China on Feb. 24, 2021, the entire contents of which are incorporated herein by reference.

TECHNICAL FIELD

The present disclosure relates to the technical field of display, in particular to a display driving module, a display driving method, and a display device.

BACKGROUND

In the related art, the larger the display panel is, the higher the resolution is. As the size of the screen of the display panel increases and the resolution increases, the load in the display panel also increases, and under a heavy load, the gate driving signal is significantly attenuated at the far end, which seriously affects the far-end charging rate and the charging uniformity in the display panel. The low remote charging rate may cause insufficient charging of the remote pixel circuit, resulting in dark remote pixels included in the display panel and non-uniform display of the display panel.

SUMMARY

A display driving module is provided in the present disclosure, including a clock signal line, a clock signal generating circuit and a gate driving circuit, where the gate driving circuit includes multiple stages of gate driving units;

the clock signal generating circuit is electrically connected to the clock signal line and is configured to generate at least two clock signals and provide different clock signals to the clock signal line in a time-sharing manner;

the gate driving unit is electrically connected to the clock signal line and configured to generate a gate driving signal according to the clock signals on the clock signal line;

when potentials of the clock signals are valid voltages, the potentials of different clock signals are different.

Optionally, the gate driving unit is configured to transmit the gate driving signal to a pixel circuit included in a display panel;

a transistor in the pixel circuit having a control electrode connected to the gate driving signal is an N-type transistor, the valid voltage is a high voltage; or the transistor in the pixel circuit having a control electrode connected to the gate driving signal is a P-type transistor, the valid voltage is a low voltage.

Optionally, the clock signal generating circuit includes a timing sequence controller, a voltage generating sub-circuit, a control sub-circuit, and a clock signal generating sub-circuit, where, the voltage generating sub-circuit is configured to generate an invalid voltage signal and at least two valid voltage signals and provide the invalid voltage signal to the clock signal generating sub-circuit;

the timing sequence controller is configured to provide a control signal to the control sub-circuit through a control signal end and provide an input clock signal to the clock signal generating sub-circuit through an input clock signal end;

the control sub-circuit is electrically connected to the control signal end and the voltage generating sub-circuit and is configured to provide a corresponding valid voltage signal in the at least two valid voltage signals to the clock signal generating sub-circuit under a control of the control signal;

the clock signal generating sub-circuit is electrically connected to the timing sequence controller, the control sub-circuit, and the clock signal line, and is configured to generate a corresponding clock signal according to the input clock signal, the invalid voltage signal, and the corresponding valid voltage signal, and to provide the clock signal to the clock signal line.

Optionally, the voltage generating sub-circuit is configured to generate a first valid voltage signal and a second valid voltage signal, and output the first valid voltage signal through a first output end and output the second valid voltage signal through a second output end;

the control sub-circuit includes a first control transistor and a second control transistor;

a control electrode of the first control transistor is electrically connected to the control signal end, a first electrode of the first control transistor is electrically connected to the first output end, and a second electrode of the first control transistor is electrically connected to the clock signal generating circuit; and a control electrode of the second control transistor is electrically connected to the control signal end, the first electrode of the second control transistor is electrically connected to the second output end, and the second electrode of the second control transistor is electrically connected to the clock signal generating circuit.

Optionally, the voltage generating sub-circuit includes a power management integrated circuit;

the power management integrated circuit includes at least three voltage conversion circuits;

one of the at least three voltage conversion circuits is configured to convert a first predetermined voltage signal into the invalid voltage signal;

at least two of the at least three voltage conversion circuits are configured to convert a second predetermined voltage signal into corresponding valid voltage signals.

Optionally, the voltage generating sub-circuit includes a power management integrated circuit and a voltage generating integrated circuit;

the power management integrated circuit is configured to generate the invalid voltage signal and a first valid voltage signal;

the voltage generating integrated circuit is configured to convert a third predetermined voltage signal into a corresponding at least one of the valid voltage signals.

A display driving method is further provided in the present disclosure, applied to a display driving module, where the display driving module including a clock signal line, a clock signal generating circuit and a gate driving circuit, where the gate driving circuit includes multiple stages of gate driving units;

the clock signal generating circuit is electrically connected to the clock signal line and is configured to generate at least two clock signals and provide different clock signals to the clock signal line in a time-sharing manner;

the gate driving unit is electrically connected to the clock signal line and configured to generate a gate driving signal according to the clock signals on the clock signal line;

when potentials of the clock signals are valid voltages, the potentials of different clock signals are different the display driving method includes:

a clock signal generating circuit generating at least two clock signals and providing different clock signals to the clock signal lines in a time-sharing manner;

the gate driving unit generating a gate driving signal according to a clock signal on the clock signal line.

Optionally, the gate driving circuit is configured to transmit the gate driving signal to a pixel circuit included in a display panel through a gate line included in the display panel, the clock signal generating circuit is disposed at a first side of the display panel, a second side is a side opposite to the first side, the clock signal line extends from the first side to the second side, and an extending direction of the gate line intersects an extending direction of the clock signal line; the effective display area of the display panel is sequentially divided into B display areas along the extending direction of the clock signal line; B is an integer greater than 1; the display driving method includes:

when the gate driving circuit provides a gate driving signal for the gate line in the b-th display area, the clock signal generating circuit providing a b-th clock signal for the clock signal line; b is a positive integer less than or equal to B;

when the potential of the a-th clock signal and the potential of the (a+1)-th clock signal are valid voltages, an absolute value of the potential of the (a+1)-th clock signal is larger than an absolute value of the potential of the a-th clock signal; a is a positive integer less than B.

Optionally, the gate driving circuit is configured to transmit the gate driving signal to pixel circuits included in the display panel through gate lines included in the display panel, and the pixel circuits included in the display panel in a same row are electrically connected to the gate lines in a corresponding row; the display driving method further includes:

when the display picture on the display panel has the horizontal stripes, when the gate driving circuit provides a gate driving signal for the gate line in the display area corresponding to the brighter horizontal stripes, the clock signal generating circuit providing a first clock signal for the clock signal line; when the gate driving circuit provides a gate driving signal for the gate line in the display area corresponding to the darker horizontal stripe, the clock signal generating circuit providing a second clock signal for the clock signal line;

when the potential of the first clock signal and the potential of the second clock signal are valid voltages, an absolute value of the potential of the first clock signal is smaller than an absolute value of the potential of the second clock signal.

A display device is further provided in the present disclosure, including a display driving module;

the display driving module includes a clock signal line, a clock signal generating circuit and a gate driving circuit, where the gate driving circuit includes multiple stages of gate driving units;

the clock signal generating circuit is electrically connected to the clock signal line and is configured to generate at least two clock signals and provide different clock signals to the clock signal line in a time-sharing manner;

the gate driving unit is electrically connected to the clock signal line and configured to generate a gate driving signal according to the clock signals on the clock signal line;

when potentials of the clock signals are valid voltages, the potentials of different clock signals are different.

Optionally, the gate driving unit is configured to transmit the gate driving signal to a pixel circuit included in a display panel;

a transistor in the pixel circuit having a control electrode connected to the gate driving signal is an N-type transistor, the valid voltage is a high voltage; or the transistor in the pixel circuit having a control electrode connected to the gate driving signal is a P-type transistor, the valid voltage is a low voltage.

Optionally, the clock signal generating circuit includes a timing sequence controller, a voltage generating sub-circuit, a control sub-circuit, and a clock signal generating sub-circuit, where, the voltage generating sub-circuit is configured to generate an invalid voltage signal and at least two valid voltage signals and provide the invalid voltage signal to the clock signal generating sub-circuit;

the timing sequence controller is configured to provide a control signal to the control sub-circuit through a control signal end and provide an input clock signal to the clock signal generating sub-circuit through an input clock signal end;

the control sub-circuit is electrically connected to the control signal end and the voltage generating sub-circuit and is configured to provide a corresponding valid voltage signal in the at least two valid voltage signals to the clock signal generating sub-circuit under a control of the control signal;

the clock signal generating sub-circuit is electrically connected to the timing sequence controller, the control sub-circuit, and the clock signal line, and is configured to generate a corresponding clock signal according to the input clock signal, the invalid voltage signal, and the corresponding valid voltage signal, and to provide the clock signal to the clock signal line.

Optionally, the voltage generating sub-circuit is configured to generate a first valid voltage signal and a second valid voltage signal, and output the first valid voltage signal through a first output end and output the second valid voltage signal through a second output end;

the control sub-circuit includes a first control transistor and a second control transistor;

a control electrode of the first control transistor is electrically connected to the control signal end, a first electrode of the first control transistor is electrically connected to the first output end, and a second electrode of the first control transistor is electrically connected to the clock signal generating circuit; and a control electrode of the second control transistor is electrically connected to the control signal end, the first electrode of the second control transistor is electrically connected to the second output end, and the second electrode of the second control transistor is electrically connected to the clock signal generating circuit.

Optionally, the voltage generating sub-circuit includes a power management integrated circuit;

the power management integrated circuit includes at least three voltage conversion circuits;

one of the at least three voltage conversion circuits is configured to convert a first predetermined voltage signal into the invalid voltage signal;

at least two of the at least three voltage conversion circuits are configured to convert a second predetermined voltage signal into corresponding valid voltage signals.

Optionally, the voltage generating sub-circuit includes a power management integrated circuit and a voltage generating integrated circuit;

the power management integrated circuit is configured to generate the invalid voltage signal and a first valid voltage signal;

the voltage generating integrated circuit is configured to convert a third predetermined voltage signal into a corresponding at least one of the valid voltage signals.

DETAILED DESCRIPTION

The technical solutions in the embodiments of the present disclosure will be described clearly and completely with reference to the drawings in the embodiments of the present disclosure, and it is obvious that the embodiments described are only some embodiments of the present disclosure, rather than all embodiments. All other embodiments, which can be derived by a person skilled in the art from the embodiments disclosed herein without making any creative effort, shall fall within the protection scope of the present disclosure.

The transistors used in all embodiments of the present disclosure may be transistors, thin film transistors, or field effect transistors or other devices with the same characteristics. In the embodiments of the present disclosure, to distinguish two poles of a transistor except for a control pole, one pole is referred to as a first pole, and the other pole is referred to as a second pole.

In practical operation, when the transistor is a triode, the control electrode may be a base electrode, the first electrode may be a collector electrode, and the second electrode may be an emitter electrode; alternatively, the control electrode may be a base electrode, the first electrode may be an emitter electrode, and the second electrode may be a collector electrode.

In practical operation, when the transistor is a thin film transistor or a field effect transistor, the control electrode may be a gate electrode, the first electrode may be a drain electrode, and the second electrode may be a source electrode; alternatively, the control electrode may be a gate electrode, the first electrode may be a source electrode, and the second electrode may be a drain electrode.

Figure 1:
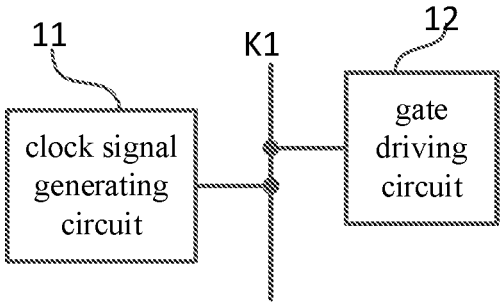
FIG. 1 is a structural diagram of a display driving module according to an embodiment of the disclosure.

As shown in FIG. 1, the display driving module according to the embodiment of the present disclosure includes a clock signal line K1, a clock signal generating circuit 11, and a gate driving circuit 12, where the gate driving circuit 12 includes a plurality of stages of gate driving units; the clock signal generating circuit 11 is electrically connected to the clock signal line K1, and is configured to generate at least two clock signals and provide different clock signals to the clock signal line K1 in a time-sharing manner; the gate driving unit in the gate driving circuit 12 is electrically connected to the clock signal line K1, and is configured to generate a gate driving signal according to a clock signal on the clock signal line K1; when the potential of the clock signal is a valid voltage, the potential of different clock signals is different.

When the display driving module according to the embodiment of the present disclosure works, different clock signals may be provided to the clock signal line K1 in a time-sharing manner through the clock signal generating circuit 11, and the gate driving unit in the gate driving circuit 12 may generate different gate driving signals according to the different clock signals.

In the embodiment of the present disclosure, when the potential of the clock signal is a valid voltage, the potentials of different clock signals are different, and thus when the potential of the gate driving signal generated by the gate driving circuit 12 is a valid voltage, the potentials of the gate driving signals are different.

For example, when the valid voltage is a high voltage and the clock signal generating circuit 11 generates the first clock signal and the second clock signal, the high voltage value of the first clock signal is not equal to the high voltage value of the second clock signal.

In at least one embodiment of the present disclosure, when the valid voltage is a high voltage, when the potential of the first clock signal and the potential of the second clock signal are high voltages, the potential of the first clock signal (i.e., the high voltage value of the first clock signal) may be 27V, and the potential of the second clock signal (i.e., the high voltage value of the second clock signal) may be 34V; the first clock signal can be provided to the gate driving unit at the near end, and the second clock signal can be provided to the gate driving unit at the far end; when the potential of the first clock signal and the potential of the second clock signal are low voltages, both the potential of the first clock signal and the potential of the second clock signal may be −7V.

Figure 2:
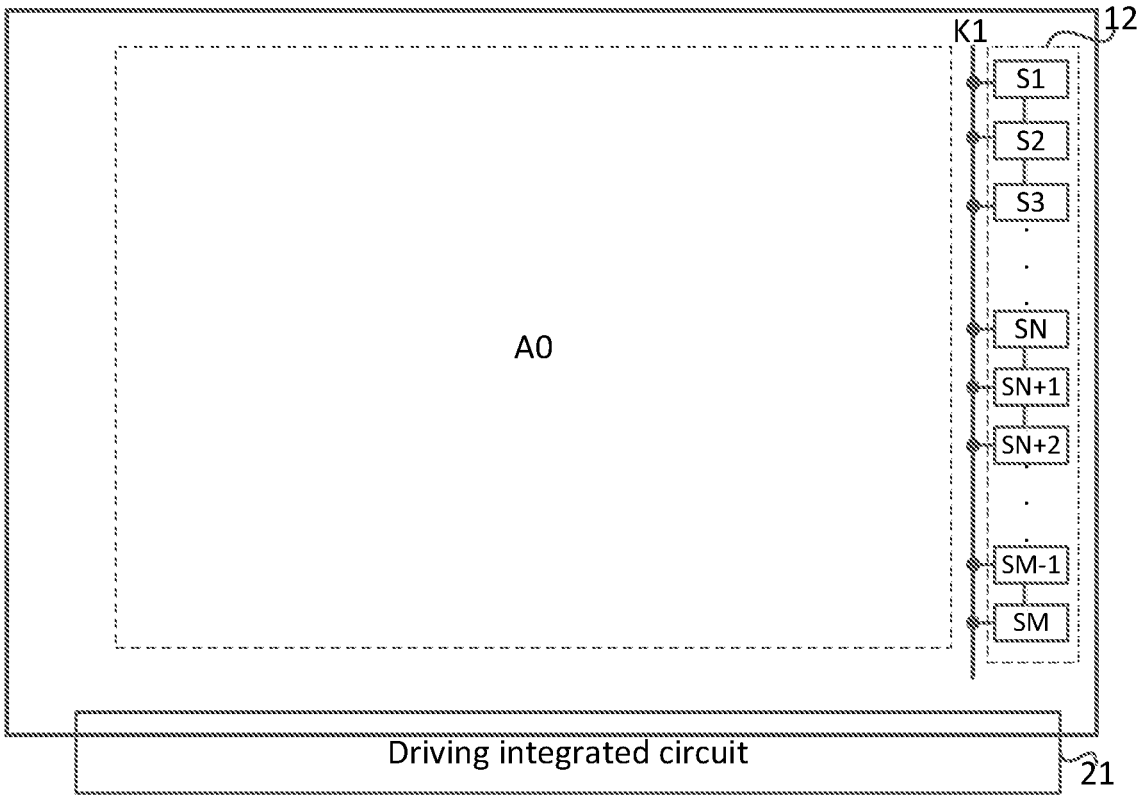
FIG. 2 (Related Art)
FIG. 2 is a schematic diagram of the relative positions of a display panel 20, a driving integrated circuit 21 and a gate driving circuit 12.

In the related art, as shown in FIG. 2, a driving integrated circuit 21 may be provided at a lower side of the display panel 20; the driving integrated circuit 21 may include a data driving circuit and a clock signal generating circuit, where the clock signal generating circuit may include a timing sequence controller, a power management integrated circuit, and a clock signal generating sub-circuit; the data driving circuit is configured to provide data voltages for data lines (not shown in FIG. 2) included in the display panel, and the clock signal generating circuit is configured to provide clock signals for a clock signal line K1; the clock signal line K1 and the gate driving circuit may be disposed on the left side and/or the right side of the display panel, and in at least one embodiment shown in FIG. 2, the clock signal line K1 and the gate driving circuit 12 are disposed on the right side of the display panel as an example.

In FIG. 2, reference numeral a0 is an effective display area of the display panel; the display panel 20 includes a plurality of rows of gate lines arranged transversely and a plurality of columns of data lines arranged longitudinally, and the clock signal line K1 is also arranged longitudinally; the multiple stages of gate driving units included in the gate driving circuit are sequentially arranged along the longitudinal direction.

In FIG. 2, a gate driving unit of a first stage denoted by S1 and included in the gate driving circuit 12, a gate driving unit of a second stage denoted by S2 and included in the gate driving circuit 12, a gate driving unit of a third stage denoted by S3 and included in the gate driving circuit 12, a gate driving unit of an nth stage denoted by SN and included in the gate driving circuit 12, a gate driving unit of an N+1 stage denoted by SN+1 and included in the gate driving circuit 12, a gate driving unit of an N+2 stage denoted by SN+2 and included in the gate driving circuit, a gate driving unit of an M−1 stage denoted by SM−1 and a gate driving unit of an M stage denoted by SM; where N is an integer greater than 3, and M is an integer greater than 7; each stage of gate driving unit is electrically connected to the clock signal line K1, and generates corresponding gate driving signals according to the clock signal on the clock signal line K1; the lower end of the clock signal line K1 is electrically connected to the clock signal generating circuit in the driving integrated circuit 21, and due to the load in the display panel, the absolute value of the voltage value of the valid voltage corresponding to the gate driving signal output by the gate driving unit at the far end is reduced, which results in a low charging rate of the pixel circuit at the far end.

For example, when the valid voltage is a high voltage, if the potential of the gate driving signal is 34V when the gate driving signal is a valid voltage signal, the voltage value of the valid voltage corresponding to the gate driving signal is 34V.

In at least one embodiment of the present disclosure, the far-end pixel circuit refers to a pixel circuit far away from the driving integrate circuit 21, and the far-end gate driving unit refers to a gate driving unit for providing a gate driving signal to the far-end pixel circuit; the pixel circuit at the near end refers to a pixel circuit which is closer to the driving integrated circuit 21, and the gate driving unit at the near end refers to a gate driving unit which supplies a gate driving signal to the pixel circuit at the near end.

In the embodiment shown in FIGS. 2, S1, S2, and S3 may be distal gate driving units, and SM−1 and SM may be proximal gate driving units.

In the related display device, because the pixel circuit in the effective display area of the display panel has a parasitic capacitance, when the display panel is in normal display, the data voltage on the data line will jump all the time, the gate driving signal on the gate line will jump high and low, the jump of these voltages will generate parasitic capacitance coupling, and at the same time, the inevitable ITO (indium tin oxide) Shift phenomenon exists in the screen, and the cross-stripe phenomenon may be generated. The transverse horizontal stripes defect phenomenon can be as follows: bright and dark cross horizontal stripes can occur in at least part of the display area in the effective display area; the extending direction of the transverse horizontal stripes is approximately the same as the extending direction of the gate line.

In at least one embodiment of the present disclosure, the absolute value of the voltage value of the valid voltage corresponding to the gate driving signal on the gate line in the display area corresponding to the brighter horizontal stripes is increased, the absolute value of the voltage value of the valid voltage corresponding to the gate driving signal on the gate line in the display area corresponding to the brighter horizontal stripes is decreased, and the brightness difference between the pixel circuits in different rows is adjusted, so as to avoid horizontal stripes.

The display driving module can effectively prevent defects such as transverse horizontal stripes and the like, can debug display panels with different sizes and different resolutions, increases the far-end charging rate, and adjusts the brightness difference between pixel circuits in different rows; the display driving module according to at least one embodiment of the present disclosure may be applied to a liquid crystal display device or an OLED (organic light emitting diode) display device.

In specific implementation, the gate driving unit is configured to transmit the gate driving signal to a pixel circuit included in a display panel; a transistor of which a control electrode in the pixel circuit is connected to the gate driving signal is an N-type transistor, and the valid voltage is a high voltage; or a transistor of which a control electrode in the pixel circuit is connected to the gate driving signal is a P-type transistor, and the valid voltage is a low voltage.

Figure 3:
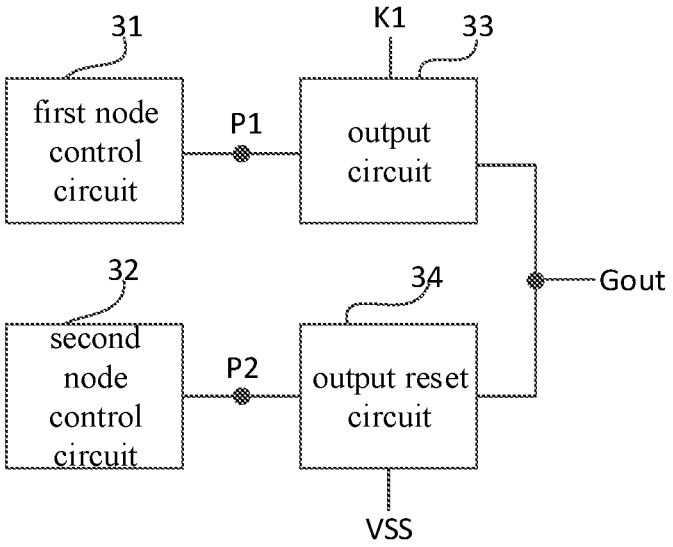
FIG. 3 is a circuit diagram of a gate driving unit in an embodiment of the present disclosure.

In at least one embodiment of the present disclosure, a circuit structure of the gate driving unit may be as shown in FIG. 3; as shown in FIG. 3, at least one embodiment of the gate driving unit may include a first node control circuit 31, a second node control circuit 32, an output circuit 33, an output reset circuit 34, and an output end Gout; the first node control circuit 31 is electrically connected to a first node P1, the first node control circuit 31 is used for controlling the potential of a first node P1; the second node control circuit 32 is electrically connected to a second node P2, the second node control circuit 32 is used for controlling the potential of a second node P2; the output circuit 33 is electrically connected to the first node P1, the clock signal line K1 and the output end Gout, and is used for controlling the communication between the output end Gout and the clock signal line K1 under the control of the potential of the first node P1; the output reset circuit 34 is electrically connected to the second node P2, a low voltage terminal and the output end Gout, respectively, and is configured to control the connection between the output end Gout and the low voltage terminal under the control of the potential of the second node P2; the low voltage terminal is configured to provide a low voltage signal VSS.

When at least one embodiment of the gate driving unit shown in FIG. 3 operates, the valid voltage may be a high voltage, and the invalid voltage may be a low voltage; during the charging phase, K1 may provide an invalid voltage signal, and the output circuit 33 controls the connection between the output end Gout and the clock signal line K1 under the control of the potential of the first node P1, so that Gout provides the invalid voltage signal; in the output stage, K1 can provide a valid voltage signal, and the output circuit 33 controls the connection between the output end Gout and the clock signal line K1 under the control of the potential of the first node P1, so that Gout provides the valid voltage signal; in the reset phase, the output reset circuit 34 controls the connection between the output end Gout and the low voltage terminal under the control of the potential of the second node P2.

Figure 4:
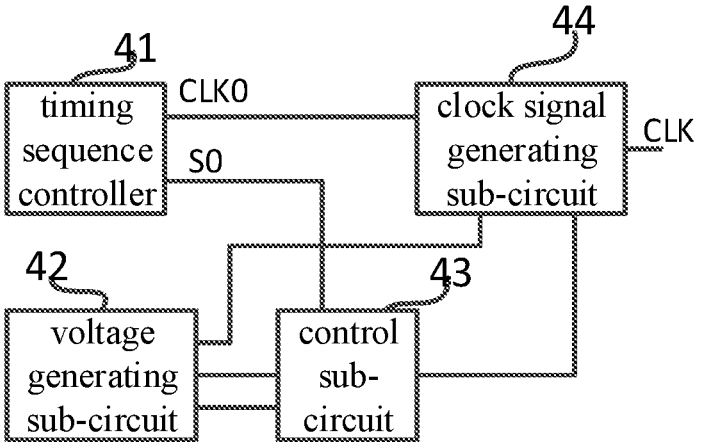
FIG. 4 is a circuit diagram of a clock signal generating circuit in a display driving module according to an embodiment of the present disclosure.

Alternatively, as shown in FIG. 4, the clock signal generating circuit includes a timing sequence controller 41, a voltage generating sub-circuit 42, a control sub-circuit 43, and a clock signal generating sub-circuit 44, where, the voltage generating sub-circuit 42 is configured to generate an invalid voltage signal and at least two valid voltage signals, and provide the invalid voltage signal to the clock signal generating sub-circuit 44; the timing sequence controller 41 is configured to provide a control signal S0 to the control sub-circuit 43 through a control signal end and provide an input clock signal CLK0 to the clock signal generating sub-circuit through an input clock signal end; the control sub-circuit 43 is electrically connected to the control signal end and the voltage generating sub-circuit 42, respectively, and is configured to control the supply of the corresponding valid voltage signal of the at least two valid voltage signals to the clock signal generating sub-circuit 44 under the control of the control signal S0; the clock signal generating sub-circuit 44 is electrically connected to the timing sequence controller 41, the control sub-circuit 43, and the clock signal line K1, respectively, for generating a corresponding clock signal CLK from the input clock signal CLK0, the invalid voltage signal, and the corresponding valid voltage signal, and supplying the clock signal CLK to the clock signal line K1.

In at least one embodiment of the present disclosure, the timing sequence controller 41 may provide at least one control signal to the control sub-circuit 43.

In operation of at least one embodiment of the clock signal generating circuit of the present disclosure as shown in FIG. 4, the voltage generating sub-circuit 42 generates an invalid voltage signal and at least two valid voltage signals; the timing sequence controller 41 supplies a control signal S0 to the control sub-circuit 43 through a control signal end and supplies an input clock signal CLK0 to the clock signal generating sub-circuit through an input clock signal end; the control sub-circuit 43 controls the supply of the respective valid voltage signal of the at least two valid voltage signals to the clock signal generating sub-circuit 44 under the control of the control signal S0; the clock signal generating sub-circuit 44 generates a corresponding clock signal CLK from the input clock signal CLK0, the inactive voltage signal, and the corresponding active voltage signal, and supplies the clock signal CLK to the clock signal line K1.

In practical implementation, the clock signal generating sub-circuit 44 generates the corresponding clock signal CLK according to the input clock signal CLK0, the invalid voltage signal and the corresponding valid voltage signal, which means that: the duty ratio of the control CLK0 is the same as the duty ratio of the CLK, the rising edge of the CLK0 is controlled to be aligned with the rising edge of the CLK (namely, the CLK0 and the CLK rise simultaneously), the falling edge of the CLK0 is controlled to be aligned with the falling edge of the CLK (namely, the CLK0 and the CLK fall simultaneously), the voltage value of the invalid voltage of the CLK is set as the voltage value of the invalid voltage signal, and the voltage value of the valid voltage of the CLK is set as the voltage value of the corresponding valid voltage signal.

In at least one embodiment of the present disclosure, the voltage value of the valid voltage of CLK refers to: when the potential of CLK is valid voltage, the potential of CLK; the voltage value of the inactive voltage of CLK means: when the potential of CLK is an inactive voltage, the potential of CLK.

Figure 5:
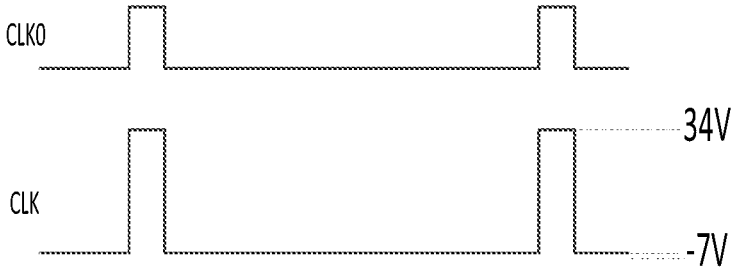
FIG. 5 is a waveform of CLK0 and a waveform of CLK.

For example, when the invalid voltage signal is a low voltage signal, the invalid voltage signal has a voltage value of −7V, the valid voltage signal is a high voltage signal, and the valid voltage signal has a voltage value of 34V, the waveform diagram of CLK0 and the waveform diagram of CLK may be as shown in FIG. 5.

In at least one embodiment of the present disclosure, the voltage generating sub-circuit is configured to generate a first valid voltage signal and a second valid voltage signal, and output the first valid voltage signal through a first output end and output the second valid voltage signal through a second output end; the control sub-circuit includes a first control transistor and a second control transistor; a control electrode of the first control transistor is electrically connected to the control signal end, a first electrode of the first control transistor is electrically connected to the first output end, and a second electrode of the first control transistor is electrically connected to the clock signal generating circuit; and a control electrode of the second control transistor is electrically connected to the control signal end, the first electrode of the second control transistor is electrically connected to the second output end, and the second electrode of the second control transistor is electrically connected to the clock signal generating circuit.

In particular implementation, the type of the first control transistor needs to be opposite to the type of the second control transistor; for example, when the first control transistor is an n-type transistor, the second control transistor is a p-type transistor; when the first control transistor is a p-type transistor, the second control transistor is an n-type transistor.

Figure 6:
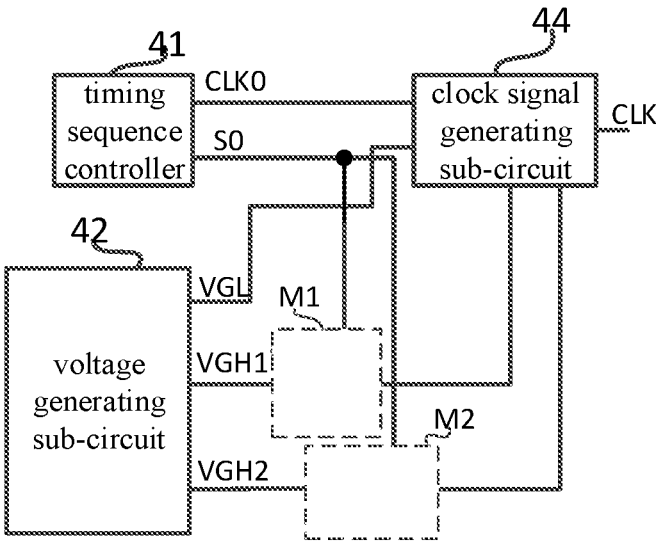
FIG. 6 is a circuit diagram of a clock signal generating circuit according to an embodiment of the present disclosure.

As shown in FIG. 6, based on at least one embodiment of the clock signal generating circuit shown in FIG. 4, the voltage generating sub-circuit 42 is configured to generate a first high voltage signal VGH1 and a second high voltage signal VGH2, and output the first high voltage signal VGH1 through a first output end and output the second high voltage signal VGH2 through a second output end; the voltage generating sub-circuit is further configured to generate a low voltage signal VGL to the clock signal generating sub-circuit 44; the control sub-circuit 43 includes a first control transistor M1 and a second control transistor M2; the gate of the first control transistor M1 is connected to the control signal S0, the drain of the first control transistor M1 is connected to the first high voltage signal VGH1, and the source of the first control transistor M1 is electrically connected to the clock signal generating sub-circuit 44; the gate of the second control transistor M2 is connected to the control signal S0, the source of the second control transistor M2 is connected to the second high voltage signal VGH2, and the drain of the second control transistor M2 is electrically connected to the clock signal generating sub-circuit 44.

In at least one embodiment of the clock signal generating circuit shown in FIG. 6, the voltage value of VGH2 may be greater than the voltage value of VGH 1; m1 is NMOS transistor (N-type metal-oxide-semiconductor transistor), M2 is PMOS transistor (P-type metal-oxide-semiconductor transistor).

In the embodiment shown in FIG. 6, the clock signal generating sub-circuit 44 generates two clock signals and supplies the different clock signals to the clock signal line K1 in a time-sharing manner.

In operation of at least one embodiment of the clock signal generating circuit shown in FIG. 6, when the control signal S0 provided by the timing sequence controller 41 is a high voltage signal, M1 is turned on, M2 is turned off, and VGH1 is provided to the clock signal generating sub-circuit 44; when the control signal S0 provided by the timing sequence controller is a low voltage signal, M1 is turned off, M2 is turned on, and VGH2 is provided to the clock signal generating sub-circuit 44.

Figure 7:
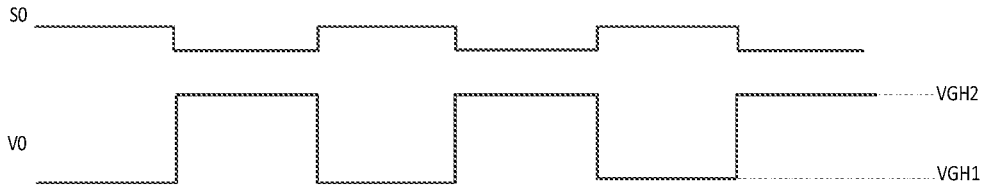
FIG. 7 is an operational timing diagram of the clock signal generating circuit shown in FIG. 6 according to an embodiment of the present disclosure.

As shown in FIG. 7, at least one embodiment of the clock signal generating circuit shown in FIG. 6 is operative, when the potential of S0 is a high voltage, the voltage signal V0 supplied to the clock signal generating sub-circuit 44 is VGH 1; when the potential of S0 is a low voltage, the voltage signal V0 supplied to the clock signal generating sub-circuit 44 is VGH 2.

In a specific implementation, the voltage generating sub-circuit 42 may provide at least three high voltage signals, for example, when the voltage generating sub-circuit 42 provides four high voltage signals, the number of the control signals S0 provided by the timing sequence controller 41 may be two, and the number of the control transistors included in the control sub-circuit 43 may be four.

According to an embodiment of the present disclosure, the voltage generating sub-circuit includes a power management integrated circuit; the power management integrated circuit includes at least three voltage conversion circuits; one of the at least three voltage conversion circuits is configured to convert a first predetermined voltage signal into the invalid voltage signal; at least two of the at least three voltage conversion circuits are configured to convert a second predetermined voltage signal into corresponding valid voltage signals, respectively.

In at least one embodiment of the present disclosure, a power management integrated circuit may be used to generate an invalid voltage signal and at least two valid voltage signals, where a PMIC (power management integrated circuit) needs to be re-customized, and at least three voltage conversion circuits are required inside the PMIC to generate the invalid voltage signal and the at least two valid voltage signals.

Optionally, the voltage conversion circuit may be a charge pump or a voltage boosting circuit, but is not limited thereto.

Optionally, the first predetermined voltage signal and the second predetermined voltage signal may be dc voltage signals; for example, when the invalid voltage signal is a low voltage signal and the valid voltage signal is a high voltage signal, the first predetermined voltage signal may be a −5V voltage signal, and the second predetermined voltage signal may be a +12V voltage signal.

According to another embodiment, the voltage generating sub-circuit includes a power management integrated circuit and a voltage generating integrated circuit; the power management integrated circuit is configured to generate the invalid voltage signal and a first valid voltage signal; the voltage generating integrated circuit is configured to convert a third predetermined voltage signal into a corresponding at least one of the valid voltage signals.

In at least one embodiment of the present disclosure, the voltage generating sub-circuit may include a power management integrated circuit and a voltage generating integrated circuit, the power management integrated circuit may be used to generate an invalid voltage signal and a valid voltage signal, and at this time, a PMIC (power management integrated circuit) is not required to be newly customized, and two voltage converting circuits are provided inside the PMIC to generate the invalid voltage signal and the valid voltage signal; at least one voltage conversion circuit can be arranged in the voltage generating integrated circuit to generate at least one valid voltage signal; thus, generation of multiple voltage signals can be achieved without re-customizing the PMIC.

The display driving method provided by the embodiment of the disclosure is applied to the display driving module, and includes the following steps: a clock signal generating circuit generates at least two clock signals and supplies different clock signals to the clock signal lines in a time-sharing manner; the gate driving unit generates a gate driving signal according to a clock signal on the clock signal line; when the potential of the clock signal is a valid voltage, the potential of different clock signals is different.

According to the display driving method disclosed by the embodiment of the disclosure, the clock signal with the higher absolute value of the voltage value of the valid voltage can be provided for the far-end gate driving unit, so that the charging rate of the far-end pixel circuit can be improved, the phenomena of insufficient charging and the like of the far-end pixel circuit included in the large-size display panel can be effectively improved, and the phenomenon of horizontal stripes can be avoided by the display driving method disclosed by the embodiment of the disclosure.

Optionally, the gate driving circuit is configured to transmit the gate driving signal to a pixel circuit included in the display panel through a gate line included in the display panel, the clock signal generating circuit is disposed at a first side of the display panel, a second side of the display panel is a side opposite to the first side, the clock signal line extends from the first side to the second side, and an extending direction of the gate line intersects an extending direction of the clock signal line; the effective display area of the display panel is sequentially divided into B display areas along the extending direction of the clock signal line; b is an integer greater than 1; the display driving method includes: when the gate driving circuit provides a gate driving signal for the gate line in the b-th display area, the clock signal generating circuit provides a b-th clock signal for the clock signal line; b is a positive integer less than or equal to B; when the potential of the a-th clock signal and the potential of the (a+1)-th clock signal are valid voltages, the absolute value of the potential of the (a+1)-th clock signal is larger than that of the potential of the a-th clock signal; a is a positive integer less than B.

Optionally, the gate driving circuit is configured to transmit the gate driving signal to the pixel circuits included in the display panel through the gate lines included in the display panel, and the pixel circuits in the same row included in the display panel are electrically connected to the gate lines in the corresponding row; the display driving method further includes: when the display picture on the display panel has the horizontal stripes, when the gate driving circuit provides a gate driving signal for the gate line in the display area corresponding to the brighter horizontal stripes, the clock signal generating circuit provides a first clock signal for the clock signal line; when the gate driving circuit provides a gate driving signal for the gate line in the display area corresponding to the darker horizontal stripe, the clock signal generating circuit provides a second clock signal for the clock signal line; when the potential of the first clock signal and the potential of the second clock signal are valid voltages, the absolute value of the potential of the first clock signal is smaller than the absolute value of the potential of the second clock signal.

In specific implementation, when the charging rates of the pixel circuits in different rows included in the display panel are different, thereby causing poor display horizontal stripes, that is, when bright and dark changes exist between the pixel circuits in different rows, at least one embodiment of the disclosure may control a first clock signal having a smaller absolute value of the voltage value of the valid voltage provided to the gate driving unit in the display region corresponding to a brighter horizontal stripes and a second clock signal having a larger absolute value of the voltage value of the valid voltage provided to the gate driving unit in the display region corresponding to a darker horizontal stripes, so as to compensate the charging rate difference between the pixel circuits in different rows and improve the poor display horizontal stripes.

For example, when the display panel has a cross stripe defect of two bright rows and two dark rows, that is, when the 4n−3 th row of pixel circuits and the 4n−2 th row of pixel circuits on the display panel are bright (n is a positive integer) and the 4n−1 th row of pixel circuits and the 4n th row of pixel circuits on the display panel are dark, when the gate driving circuit provides gate driving signals for the 4n−3 th row of gate lines and the 4n−2 th row of gate lines, the clock signal generating circuit provides a first clock signal to the clock signal line; when the gate driving circuit provides gate driving signals for the 4n−1 th row of gate lines and the 4n th row of gate lines, the clock signal generating circuit provides a second clock signal for the clock signal line so as to improve poor horizontal stripes.

The display device includes the display driving module.

The display device provided by the embodiment of the disclosure can be any product or component with a display function, such as a mobile phone, a tablet computer, a television, a display, a notebook computer, a digital photo frame, a navigator and the like.

While the foregoing is directed to embodiments of the present disclosure, it will be appreciated by those skilled in the art that various changes and modifications may be made without departing from the principles of the disclosure, and it is intended that such changes and modifications be considered as within the scope of the disclosure.

What is claimed is:

1. A display driving module, comprising a clock signal line, a clock signal generating circuit and a gate driving circuit, wherein the gate driving circuit comprises multiple stages of gate driving units;

the clock signal generating circuit is electrically connected to the clock signal line and is configured to generate at least two clock signals and provide different clock signals to the clock signal line in a time-sharing manner;

the gate driving unit is electrically connected to the clock signal line and configured to generate a gate driving signal according to the clock signals on the clock signal line;

wherein potentials of the clock signals during clock signal intervals corresponding to valid voltages, the potentials of different clock signals are different;

wherein the clock signal generating circuit comprises a timing sequence controller, a voltage generating sub-circuit, a control sub-circuit, and a clock signal generating sub-circuit, wherein the voltage generating sub-circuit is configured to generate an invalid voltage signal and at least two valid voltage signals and provide the invalid voltage signal to the clock signal generating sub-circuit;

the timing sequence controller is configured to provide a control signal to the control sub-circuit through a control signal end and provide an input clock signal to the clock signal generating sub-circuit through an input clock signal end;

the control sub-circuit is electrically connected to the control signal end and the voltage generating sub-circuit and is configured to provide a corresponding valid voltage signal in the at least two valid voltage signals to the clock signal generating sub-circuit under a control of the control signal;

the clock signal generating sub-circuit is electrically connected to the timing sequence controller, the control sub-circuit, and the clock signal line, and is configured to generate a corresponding clock signal according to the input clock signal, the invalid voltage signal, and the corresponding valid voltage signal, and to provide the clock signal to the clock signal line;

wherein the voltage generating sub-circuit is configured to generate a first valid voltage signal and a second valid voltage signal, and output the first valid voltage signal through a first output end and output the second valid voltage signal through a second output end;

the control sub-circuit comprises a first control transistor and a second control transistor;

a control electrode of the first control transistor is electrically connected to the control signal end, a first electrode of the first control transistor is electrically connected to the first output end, and a second electrode of the first control transistor is electrically connected to the clock signal generating circuit; and a control electrode of the second control transistor is electrically connected to the control signal end, the first electrode of the second control transistor is electrically connected to the second output end, and the second electrode of the second control transistor is electrically connected to the clock signal generating circuit.

2. The display driving module according to claim 1, wherein the gate driving unit is configured to transmit the gate driving signal to a pixel circuit included in a display panel;

a transistor in the pixel circuit having a control electrode connected to the gate driving signal is an N-type transistor, the valid voltage is a high voltage; or the transistor in the pixel circuit having a control electrode connected to the gate driving signal is a P-type transistor, the valid voltage is a low voltage.

3. The display driving module according to claim 1, wherein the voltage generating sub-circuit comprises a power management integrated circuit;

the power management integrated circuit comprises at least three voltage conversion circuits;

one of the at least three voltage conversion circuits is configured to convert a first predetermined voltage signal into the invalid voltage signal;

at least two of the at least three voltage conversion circuits are configured to convert a second predetermined voltage signal into corresponding valid voltage signals.

4. The display driving module according to claim 1, wherein the voltage generating sub-circuit comprises a power management integrated circuit and a voltage generating integrated circuit;

the power management integrated circuit is configured to generate the invalid voltage signal and a first valid voltage signal;

the voltage generating integrated circuit is configured to convert a third predetermined voltage signal into a corresponding at least one of the valid voltage signals.

5. A display driving method, applied to a display driving module, wherein the display driving module comprising a clock signal line, a clock signal generating circuit and a gate driving circuit, wherein the gate driving circuit comprises multiple stages of gate driving units;

the clock signal generating circuit is electrically connected to the clock signal line and is configured to generate at least two clock signals and provide different clock signals to the clock signal line in a time-sharing manner;

the gate driving unit is electrically connected to the clock signal line and configured to generate a gate driving signal according to the clock signals on the clock signal line;

wherein potentials of the clock signals during clock signal intervals corresponding to valid voltages, the potentials of different clock signals are different;

wherein the clock signal generating circuit comprises a timing sequence controller, a voltage generating sub-circuit, a control sub-circuit, and a clock signal generating sub-circuit, wherein the voltage generating sub-circuit is configured to generate an invalid voltage signal and at least two valid voltage signals and provide the invalid voltage signal to the clock signal generating sub-circuit;

the timing sequence controller is configured to provide a control signal to the control sub-circuit through a control signal end and provide an input clock signal to the clock signal generating sub-circuit through an input clock signal end;

the control sub-circuit is electrically connected to the control signal end and the voltage generating sub-circuit and is configured to provide a corresponding valid voltage signal in the at least two valid voltage signals to the clock signal generating sub-circuit under a control of the control signal;

the clock signal generating sub-circuit is electrically connected to the timing sequence controller, the control sub-circuit, and the clock signal line, and is configured to generate a corresponding clock signal according to the input clock signal, the invalid voltage signal, and the corresponding valid voltage signal, and to provide the clock signal to the clock signal line;

wherein the voltage generating sub-circuit is configured to generate a first valid voltage signal and a second valid voltage signal, and output the first valid voltage signal through a first output end and output the second valid voltage signal through a second output end;

the control sub-circuit comprises a first control transistor and a second control transistor;

a control electrode of the first control transistor is electrically connected to the control signal end, a first electrode of the first control transistor is electrically connected to the first output end, and a second electrode of the first control transistor is electrically connected to the clock signal generating circuit; and a control electrode of the second control transistor is electrically connected to the control signal end, the first electrode of the second control transistor is electrically connected to the second output end, and the second electrode of the second control transistor is electrically connected to the clock signal generating circuit; and the display driving method comprises:

a clock signal generating circuit generating at least two clock signals and providing different clock signals to the clock signal lines in a time-sharing manner;

the gate driving unit generating a gate driving signal according to a clock signal on the clock signal line.

6. The display driving method according to claim 5, wherein the gate driving circuit is configured to transmit the gate driving signal to a pixel circuit included in a display panel through a gate line included in the display panel, the clock signal generating circuit is disposed at a first side of the display panel, a second side is a side opposite to the first side, the clock signal line extends from the first side to the second side, and an extending direction of the gate line intersects an extending direction of the clock signal line; the effective display area of the display panel is sequentially divided into B display areas along the extending direction of the clock signal line; B is an integer greater than 1; the display driving method comprises:

when the gate driving circuit provides a gate driving signal for the gate line in the b-th display area, the clock signal generating circuit providing a b-th clock signal for the clock signal line; b is a positive integer less than or equal to B;

wherein potentials of the a-th clock signal and the potential of the (a+1)-th clock signal during clock signal intervals corresponding to valid voltages, an absolute value of the potential of the (a+1)-th clock signal is larger than an absolute value of the potential of the a-th clock signal; a is a positive integer less than B.

7. The display driving method according to claim 5, wherein the gate driving circuit is configured to transmit the gate driving signal to pixel circuits included in the display panel through gate lines included in the display panel, and the pixel circuits included in the display panel in a same row are electrically connected to the gate lines in a corresponding row; the display driving method further comprises:

at a position where a horizontal stripe appears in the display picture on the display panel, the clock signal generating circuit providing a first clock signal for the clock signal line in response to the gate driving circuit providing a gate driving signal for the gate line in the display area corresponding to the brighter horizontal stripes; and the clock signal generating circuit providing a second clock signal for the clock signal line in response to the gate driving circuit providing a gate driving signal for the gate line in the display area corresponding to the darker horizontal stripes, wherein the potential of the first clock signal and the potential of the second clock signal during clock signal intervals corresponding to valid voltages, an absolute value of the potential of the first clock signal is smaller than an absolute value of the potential of the second clock signal.

8. A display device, comprising a display driving module;

the display driving module comprises a clock signal line, a clock signal generating circuit and a gate driving circuit, wherein the gate driving circuit comprises multiple stages of gate driving units;

the clock signal generating circuit is electrically connected to the clock signal line and is configured to generate at least two clock signals and provide different clock signals to the clock signal line in a time-sharing manner;

the gate driving unit is electrically connected to the clock signal line and configured to generate a gate driving signal according to the clock signals on the clock signal line;

wherein potentials of the clock signals during clock signal intervals corresponding to valid voltages, the potentials of different clock signals are different;

wherein the clock signal generating circuit comprises a timing sequence controller, a voltage generating sub-circuit, a control sub-circuit, and a clock signal generating sub-circuit, wherein, the voltage generating sub-circuit is configured to generate an invalid voltage signal and at least two valid voltage signals and provide the invalid voltage signal to the clock signal generating sub-circuit;

the timing sequence controller is configured to provide a control signal to the control sub-circuit through a control signal end and provide an input clock signal to the clock signal generating sub-circuit through an input clock signal end;

the control sub-circuit is electrically connected to the control signal end and the voltage generating sub-circuit and is configured to provide a corresponding valid voltage signal in the at least two valid voltage signals to the clock signal generating sub-circuit under a control of the control signal;

the clock signal generating sub-circuit is electrically connected to the timing sequence controller, the control sub-circuit, and the clock signal line, and is configured to generate a corresponding clock signal according to the input clock signal, the invalid voltage signal, and the corresponding valid voltage signal, and to provide the clock signal to the clock signal line;

wherein the voltage generating sub-circuit is configured to generate a first valid voltage signal and a second valid voltage signal, and output the first valid voltage signal through a first output end and output the second valid voltage signal through a second output end;

the control sub-circuit comprises a first control transistor and a second control transistor;

a control electrode of the first control transistor is electrically connected to the control signal end, a first electrode of the first control transistor is electrically connected to the first output end, and a second electrode of the first control transistor is electrically connected to the clock signal generating circuit; and a control electrode of the second control transistor is electrically connected to the control signal end, the first electrode of the second control transistor is electrically connected to the second output end, and the second electrode of the second control transistor is electrically connected to the clock signal generating circuit.

9. The display device according to claim 8, wherein the gate driving unit is configured to transmit the gate driving signal to a pixel circuit included in a display panel;

a transistor in the pixel circuit having a control electrode connected to the gate driving signal is an N-type transistor, the valid voltage is a high voltage; or the transistor in the pixel circuit having a control electrode connected to the gate driving signal is a P-type transistor, the valid voltage is a low voltage.

10. The display apparatus according to claim 8, wherein the voltage generating sub-circuit comprises a power management integrated circuit;

the power management integrated circuit comprises at least three voltage conversion circuits;

one of the at least three voltage conversion circuits is configured to convert a first predetermined voltage signal into the invalid voltage signal;

at least two of the at least three voltage conversion circuits are configured to convert a second predetermined voltage signal into corresponding valid voltage signals.

11. The display apparatus according to claim 8, wherein the voltage generating sub-circuit comprises a power management integrated circuit and a voltage generating integrated circuit;

the power management integrated circuit is configured to generate the invalid voltage signal and a first valid voltage signal;

the voltage generating integrated circuit is configured to convert a third predetermined voltage signal into a corresponding at least one of the valid voltage signals.

* * * * *